US010080396B2

(12) United States Patent
Adjesson

(10) Patent No.: US 10,080,396 B2
(45) Date of Patent: Sep. 25, 2018

(54) METHOD AND APPARATUS FOR HAIR WEAVE WASH AND DRY

(71) Applicant: Eric Adjesson, Alpharetta, GA (US)

(72) Inventor: Eric Adjesson, Alpharetta, GA (US)

( * ) Notice: Subject to any disclaimer, the term of this patent is extended or adjusted under 35 U.S.C. 154(b) by 120 days.

(21) Appl. No.: 14/675,720

(22) Filed: Mar. 31, 2015

(65) Prior Publication Data

US 2016/0286880 A1 Oct. 6, 2016

(51) Int. Cl.
*A41G 5/00* (2006.01)
*B08B 3/10* (2006.01)

(52) U.S. Cl.
CPC ..... *A41G 5/004* (2013.01)

(58) Field of Classification Search
CPC ..... A41G 5/004; B08B 3/10
See application file for complete search history.

(56) References Cited

U.S. PATENT DOCUMENTS 3,662,574 A * 5/1972 Groat ..... A45D 44/14 118/500
9,492,021 B2 * 11/2016 Kebreau ..... A47F 7/065
2007/0251540 A1 * 11/2007 Cheung ..... A45D 8/30 132/279
2011/0284397 A1 * 11/2011 Batres ..... A45C 11/24 206/8
2015/0351562 A1 * 12/2015 Kebreau ..... A47F 7/065 211/30
2016/0206030 A1 * 7/2016 Sky Yi ..... B65D 29/00

OTHER PUBLICATIONS

Bellami (Bellami Hair Extensions Carrier & Hanger), Nov. 9, 2013, Bellami, date stamp tittle, discriptive paragraph, and 8 figures.*
Wikihow, (How to Wash a Hair Weave), Aug. 15, 2009, Wikihow, date stamp, tittle, paragraph discussing paragraph discusing washing and drying.*
The End Credits, (Brazilian Body Wave: Co-washing), Jul. 27, 2012, date stamp, tittle, paragraph discussing washing a brazilian body wave weave.*

* cited by examiner

*Primary Examiner* — Shamim Ahmed

(57) ABSTRACT

A wash and dry apparatus, suitable for use with hair weaves, comprises: a hair weave folder including a folder base panel hingedly attached to a folder top panel, the hair weave folder configured so as to allow the folder top panel to fold onto the folder base panel; a folder sleeve sized and shaped to completely enclose the hair weave folder when the hair weave folder is folded; and a folder sleeve cap sized and shaped to cover an open end of the folder sleeve such that the hair weave folder is retained in a water-tight volume.

5 Claims, 8 Drawing Sheets

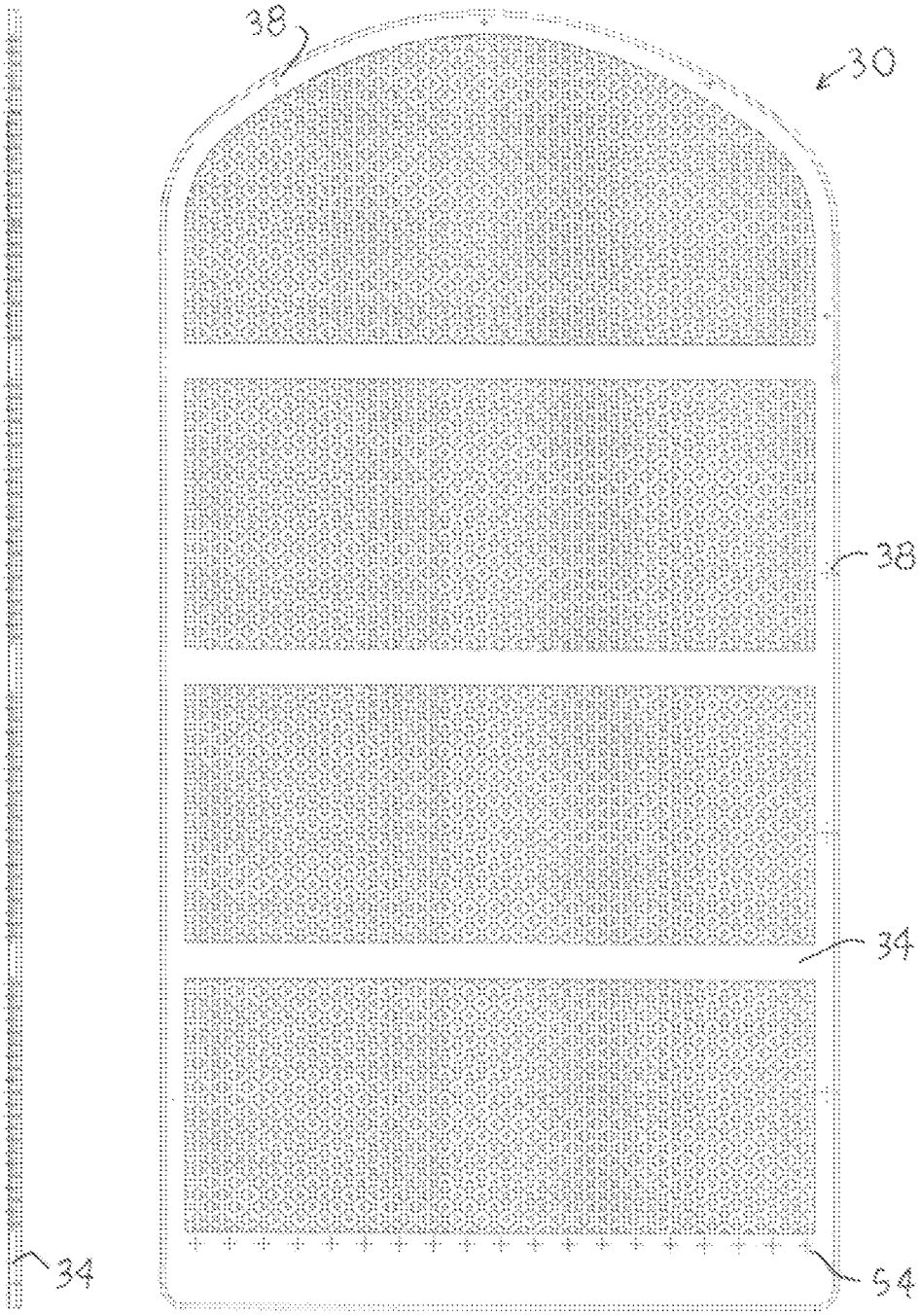
Fig. 6B
Fig. 6
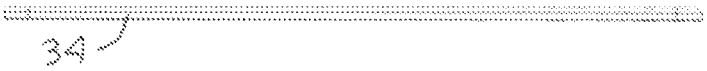
Fig. 6A

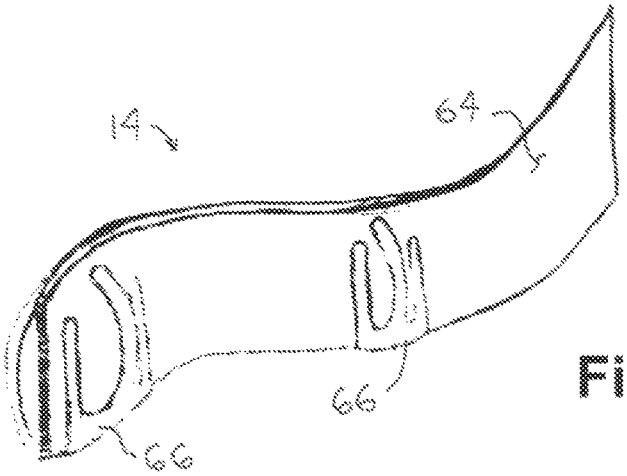
Fig. 7
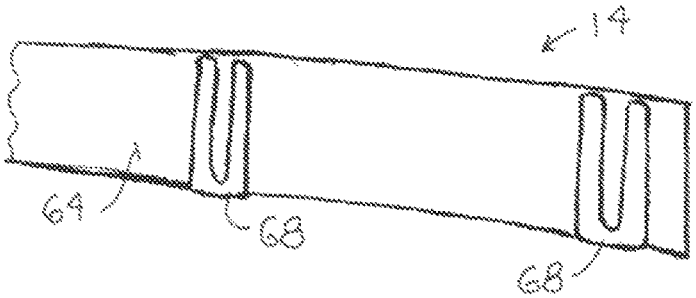
Fig. 8
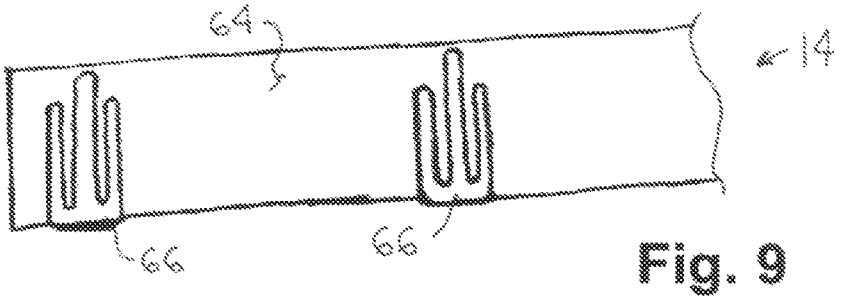
Fig. 9
Fig. 10
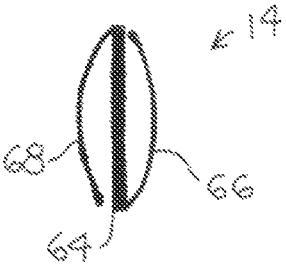

METHOD AND APPARATUS FOR HAIR WEAVE WASH AND DRY

FIELD OF THE INVENTION

The present invention relates to a method and apparatus for washing and drying hairpieces, such as hair extensions and hair weaves.

BACKGROUND OF THE INVENTION

Women spend countless hours each year in hairs salons and spend millions of dollars getting their hair extensions/weaves washed, dried, dyed, sown, fused, and hooked into the woman's hair by a stylist. In the present state of the art, no company manufactures or provides any apparatus that makes it easier for women to go through the process of washing, dying, drying and generally renewing hair extensions and hair weaves.

Women who wear hair weaves generally experience one or more common problems. First, hair weaves, for the most part, tend to be expensive accessories. Second, it can be a laborious operation to attach the hair weave to human hair or to the wearer's scalp. Third, it becomes expensive to maintain a hair weave if performed on a regular basis. And fourth, if the hair weave maintenance is not performed properly, the wearer can compromise the hygiene on her scalp.

Women who wear hair weaves thus have two options when it comes to maintaining their extensions, hair style, and keeping up with scalp health. To keep a hair weave clean, the wearer needs to patronize a hair salon where the hair weave is removed, washed, dried and reattached to woman's natural hair. This is the more expensive option which normally requires the services of a professional hair stylist if the process is to be done properly.

The less expensive option can be used on a hair extension that is attached to the wearer's head with a braid. This is a popular method of attaching the hair weave into a woman's natural hair where the woman's hair is first braided around the scalp. The hair weave is then hooked into the braided hair portion, attached with hair clips, or sown to the braided hair with needle and thread. With a braided attachment, the hair extension can be washed without detaching from the woman's scalp. This method can be performed by a professional hair stylist or by another competent individual.

The problem with the less expensive braid attachment option is that washing the hair weave that has been attached to the hair braid presents a problem because dirt and moisture can build up in the braided natural hair because it cannot be washed properly. Over time, whether the woman's hair is washed by a professional stylist in a salon, or by the individual wearing the hair weave herself, mildew often starts to build up under the braided hair causing hygiene issues and odor.

However, the process of removing, washing, drying, dying, and reattaching the hair weave to the wearer's natural hair may be laborious and time-consuming. As can be appreciated by the wearer, the hair weave may not be easily removed, depending on how the hair weave is attached. The process of removal may be time-consuming, and will probably require the assistance of another individual. Once the hair weave is removed, the weave is hand washed and dried. If desired, the hair weave can also be dyed at this time.

What is needed is a method to make it easy and practical for women to clean and maintain their hair weaves at home.

BRIEF SUMMARY OF THE INVENTION

In one aspect of the present invention, a wash and dry apparatus, suitable for use with hair weaves, comprises: a hair weave folder including a folder base panel hingedly attached to a folder top panel, the hair weave folder configured so as to allow the folder top panel to fold onto the folder base panel; a folder sleeve sized and shaped to completely enclose the hair weave folder when the hair weave folder is folded; and a folder sleeve cap sized and shaped to cover an open end of the folder sleeve such that the hair weave folder is retained in a water-tight volume.

In another aspect of the present invention, a method for washing and drying a hair weave comprises the steps of: placing the hair weave into a hair weave folder by folding a folder base panel onto a folder top panel so as to encase and keep the hair weave in a flattened configuration; placing the hair weave folder with the hair weave into a folder sleeve; adding a washing solution to the folder sleeve for performing the washing procedure on the hair weave; placing a folder sleeve cap over an open end of the folder sleeve to retain the washing solution in the folder sleeve; and removing the hair weave from the folder sleeve to enable drying of the hair weave.

The additional features and advantage of the disclosed invention is set forth in the detailed description which follows, and will be apparent to those skilled in the art from the description or recognized by practicing the invention as described, together with the claims and appended drawings.

BRIEF DESCRIPTIONS OF THE DRAWINGS

The foregoing aspects, uses, and advantages of the present invention will be more fully appreciated as the same becomes better understood from the following detailed description of the present invention when viewed in conjunction with the accompanying figures, in which:

FIG. 6 is a front view of the folder base of FIG. 4;

FIG. 6A is a side view of the folder base of FIG. 6;

FIG. 6B is an edge view of the folder base of FIG. 6;

FIG. 7 is a perspective view of the hair attachment strap of FIG. 1 showing a hair weave hook;

FIG. 8 is a rear view of the hair attachment strap of FIG. 7 showing a hair braid hook;

FIG. 9 is a front view of the hair attachment strap of FIG. 7;

FIG. 10 is a side view of the hair attachment strap of FIG. 7;

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention. It should be understood that the terms used herein, "hair weave," "hair extension," and "hair piece" are interchangeable and all refer to a hair accessory or product that is intended for use with the natural hair growing from a wearer's scalp, usually that of a female user.

As of now, no one else has come up with a way to make the process of maintaining a hair weave or extension easy, fast and cost effective. The disclosed method and wash and dry apparatus will do precisely that. The novel apparatus comprises a bi-fold of two meshed plates of flexible material. These may be made of plastic, rubber, or metal, for example, and hinged together like a folder. In order that a hair weave stay untangled when submerged into water, it is necessary to hold the hairs strands substantially fixed and flattened in place, and restrained from entangling together. The disclosed apparatus accomplishes this objective by holding the hair weave in place between the two meshed bi-fold plates. The mesh allows water, shampoo, and/or dye to flow through the hair accessory without the problem of entanglement. With the hair weave thus secured, the hair weave can withstand a wash cycle in a washing machine, for example, in addition to a subsequent dry cycle in a drying device, without becoming an entangled mass of hair.

By using the disclosed method and wash and dry apparatus, a woman who wears hair extensions and/or weaves will be able to remove the hair accessory from her head for washing and drying. This will enable women to maintain the health of their hair by preventing growth of mildew that tends to appear when washed in the traditional way. In addition, the novel apparatus will also allow women to dye their hair extensions, dry the hair extensions while in the flattened state, and keep their hairstyles renewed regularly without the expensive trips to the hair salons.

Figure 1:
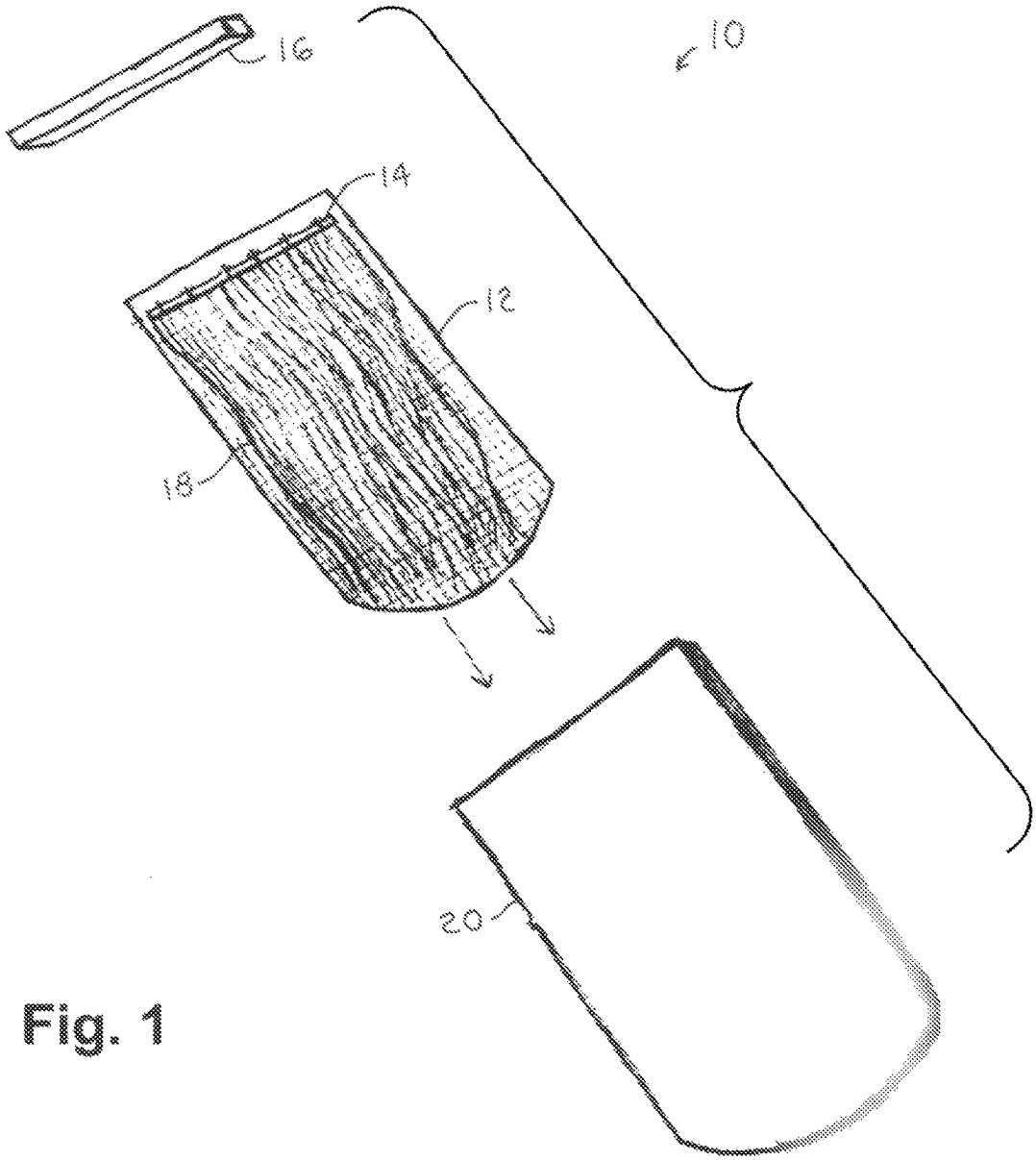
FIG. 1 is an exploded diagrammatical illustration of a hair weave wash and dry apparatus including a hair weave folder, a folder sleeve, a hair attachment strap, and a folder sleeve cap, in accordance with the present invention.

As shown in FIG. 1, a hair weave wash and dry apparatus 10 comprises a hair weave folder 12, a folder sleeve 20, and a folder sleeve cap 16, according to an aspect of the present invention. A hair weave 18 is attached to the hair weave folder 12 with a hair attachment strip 14, as described in greater detail below. It should be understood that the hair weave 18 is disposed inside the hair weave folder 12, and that a portion of the hair weave folder 12 is shown in phantom for clarity of illustration. Accordingly, as described below, the hair weave folder 12 is primarily sized and configured so as to "sandwich" and hold substantially the entire hair weave 18 flattened and in place when undergoing a wash and dry cycle, or other hair-treatment process.

The hair weave folder 12 completely fits into the folder sleeve 20. The folder sleeve 20 is sized and configured to have room for both: (i) the hair weave folder 12 and (ii) a predetermined amount of water or a dye solution, for use when the hair weave 18 is to be cleaned or dyed, or undergoing any such hair-treatment process.

Figure 2:
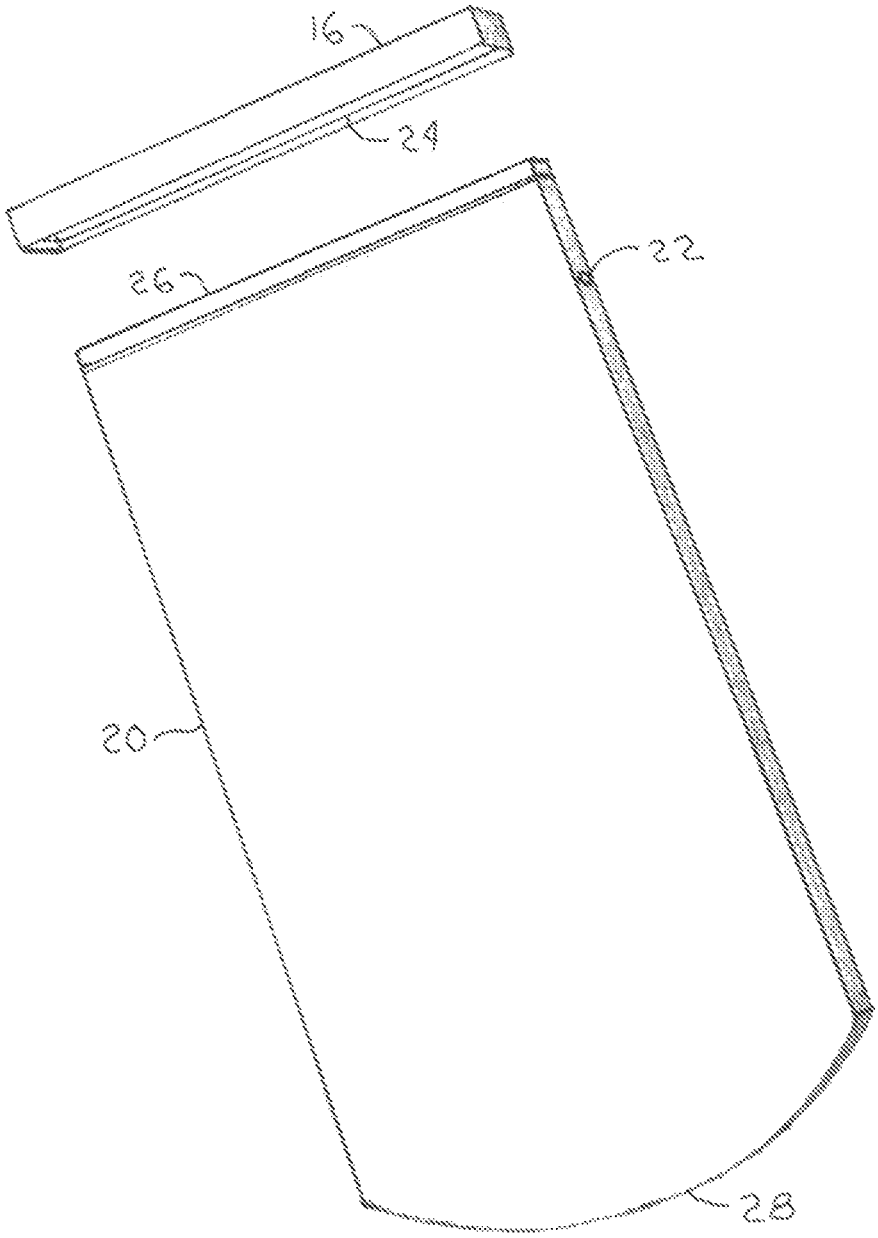
FIG. 2 is a perspective view of the folder sleeve and the folder sleeve cap of FIG. 1.

Preferably, the folder sleeve 20 may have a sealable through hole 22 located as shown in FIG. 2, or located at any convenient position along the outside of the folder sleeve 20, to provide for drainage of the water or dye solution. The folder sleeve 20 may include a rounded bottom edge 28 to more closely conform to the external shape of the hair weave folder 12. In an exemplary embodiment, the folder sleeve may have an overall length of about 26.5 inches, a width of about 6.25 inches, and a thickness of about 0.5 inch.

The folder sleeve cap 16 includes a rectangular cavity 24 sized and shaped to provide a water-tight seal when emplaced over a similarly sized and shaped upper open end 26 in the folder sleeve 20. When engaged with the open end 26, the folder sleeve cap 16 provides a water-tight volume for shampooing and dyeing the hair weave. This configuration prevents leakage of the water or dye solution placed into the folder sleeve 20.

Figure 3:
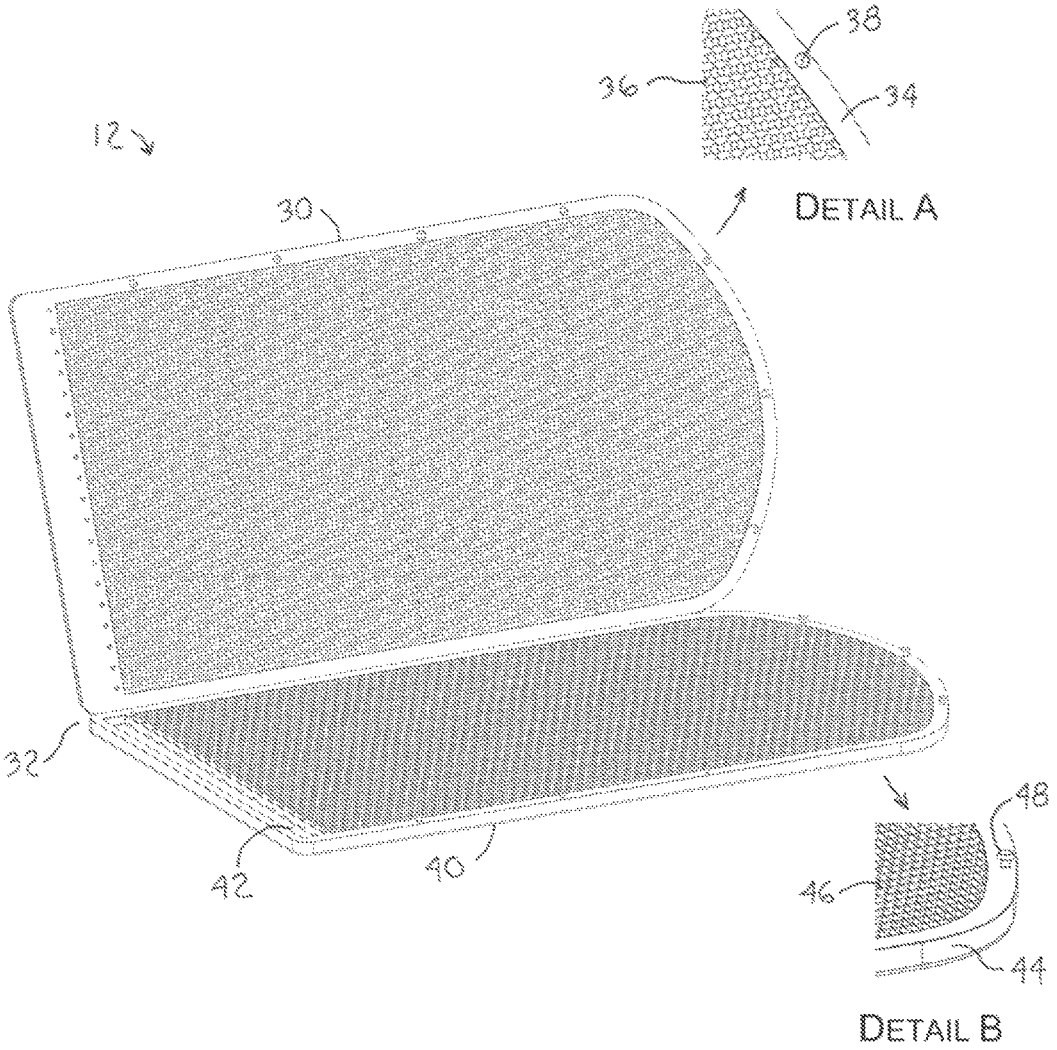
FIG. 3 is a perspective view of the hair weave folder of FIG. 1 in an open position.

FIG. 3 shows a perspective view of the hair weave folder 12 in an open position. The hair weave folder 12 comprises a folder base panel 30 attached to a folder top panel 40 by a hinged connection 32. As shown in Detail A, the configuration of the folder base panel 30 provides a base frame 34 supporting a base mesh 36. The base frame 34 functions to maintain the base mesh 36 in a basically flat state or configuration. The base frame 34 includes a plurality of base stud holes 38 positioned to receive a corresponding plurality of top panel studs 48 located in a top frame 44 of the folder top panel 40, as best seen in Detail B. The top frame 44 supports a top mesh 46, and the top frame 44 thus serves to maintain the base mesh 36 in a state of flatness or of tautness or in tension, as desired by the apparatus designer and as preferred by a user. The top frame 44 preferably includes an attachment strip channel 42 sized and shaped to removably retain the hair attachment strip 14 in the position shown in FIG. 1.

Figure 4:
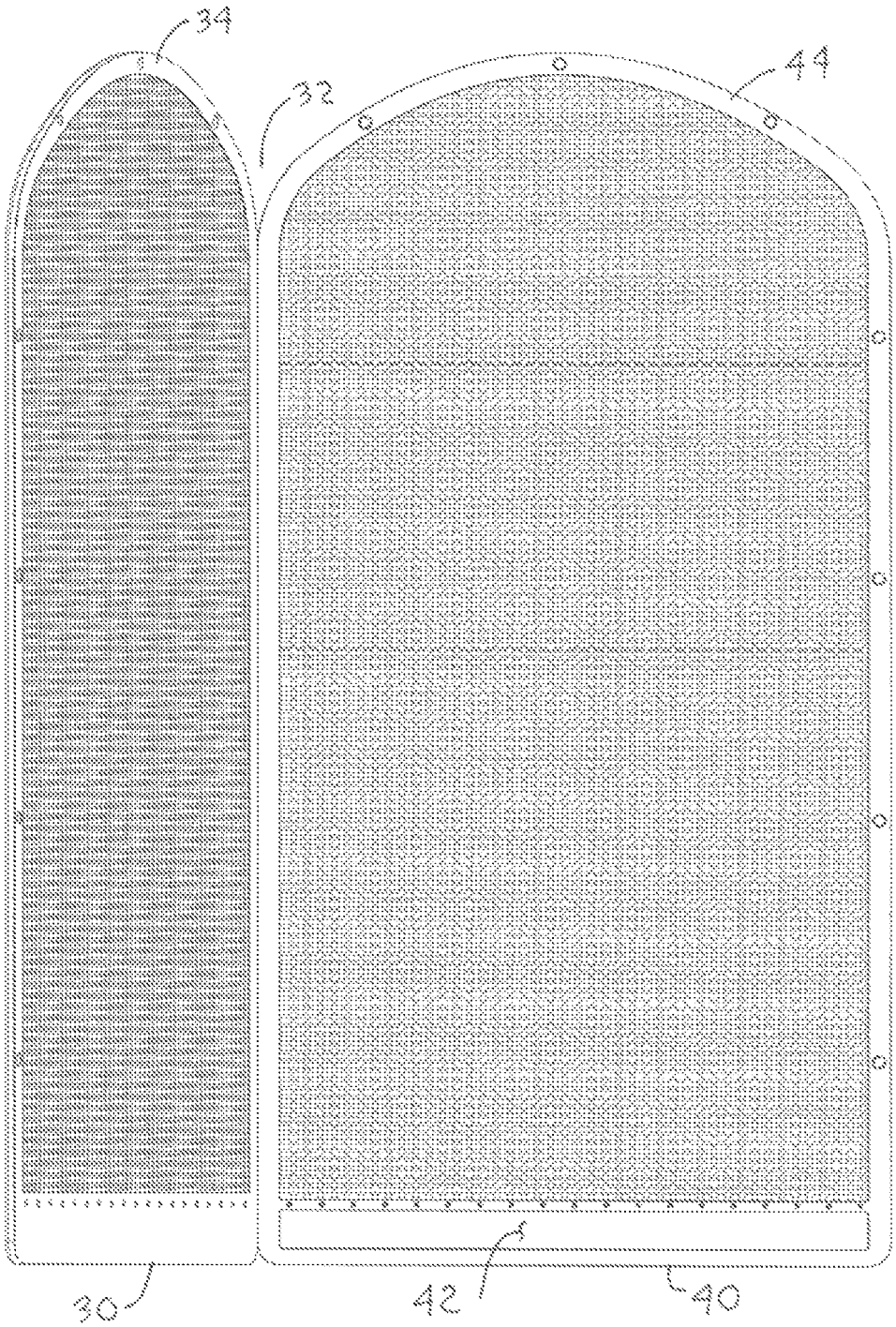
FIG. 4 is a front view of the hair weave folder of FIG. 3 showing a folder top and a folder base.

FIG. 4 shows a front view of the hair weave folder 12 in an open position. The top frame 44 includes a rounded feature at one end of the folder top panel 40, and the attachment strip channel 42 at the other end of the folder top panel 40. The base frame 34 is similarly configured with a rounded feature. Accordingly, the hinged connection 32 provides attachment of the base frame 34 to the top frame 44 only along straight side features of the frames 34, 44.

Figure 5B:
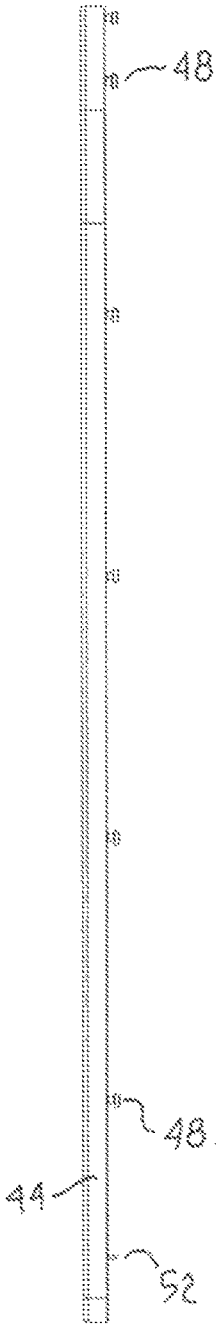
FIG. 5B is an edge view of the folder top of FIG. 5.
Figure 5:
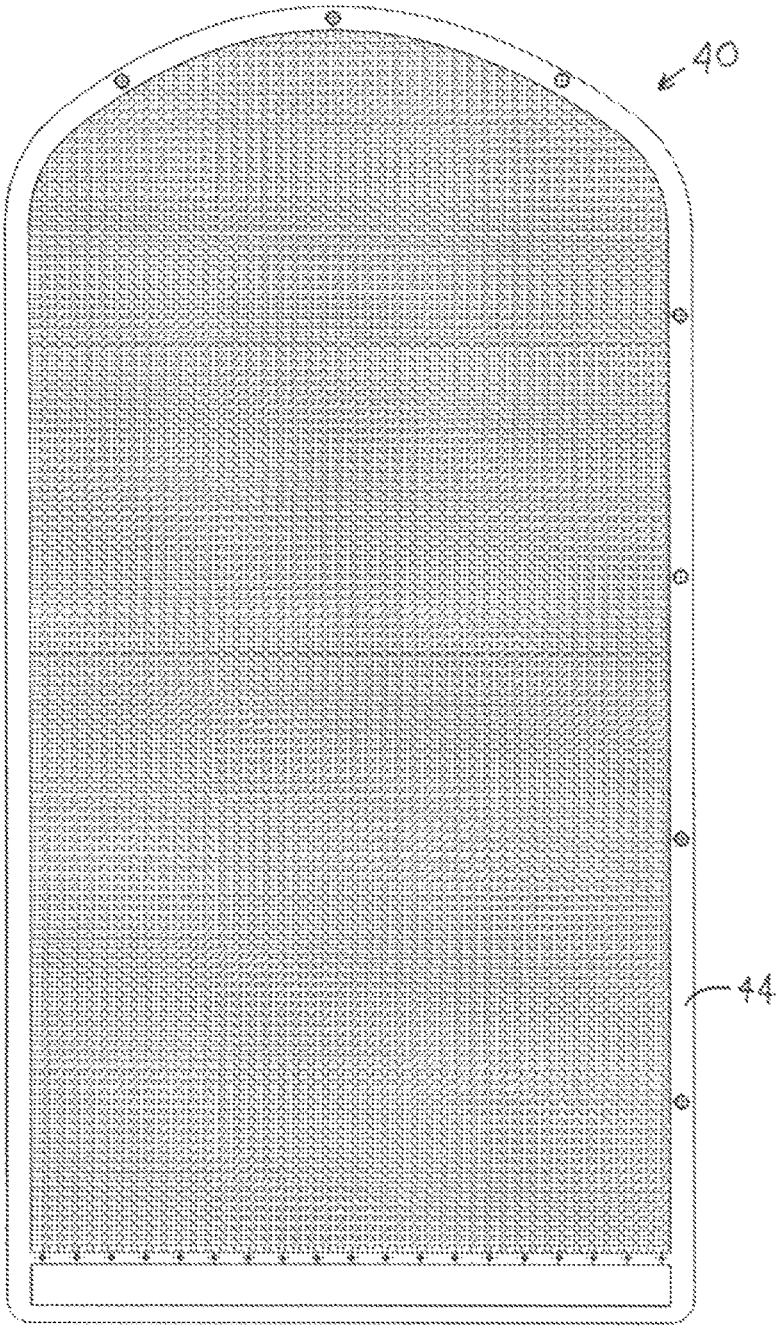
FIG. 5 is a front view of the folder top of FIG. 4.
Figure 5A:
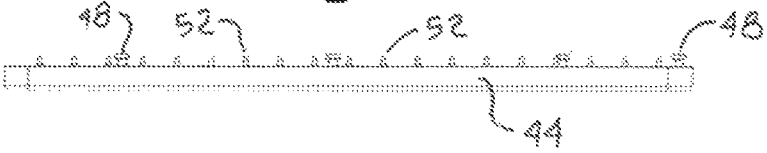
FIG. 5A is an end view of the folder top of FIG. 5.

FIG. 5 is a front view of the folder top panel 40, more clearly showing the top frame 44 and the attachment strip channel 42. FIG. 5A is an end view of the folder top panel 40 showing the plurality of top panel studs 48, and a plurality of base panel pins 52 emplaced to aid in securing the hair weave 18 in place inside the hair weave folder 12. FIG. 5B is an edge view of the folder top panel 40 showing the plurality of spaced-apart top panel studs 48 and the plurality of base panel pins 52 secured in the top frame 44.

FIG. 6 is a front view of the folder base panel 30, showing the base frame 34 and a plurality of top panel pin holes 54 disposed along one end of the base frame 34. The top panel pin holes 54 are spaced-apart so as to correspondingly line up with the plurality of base panel pins 52 in the top frame 44, shown in FIG. 5A. Also shown are the plurality of base stud holes 38 disposed along one side and the curved portion of the base frame 34. FIG. 6A is an end view of the folder base frame 34. FIG. 6B is an edge view of the folder base 30.

FIG. 7 is a perspective view of the hair attachment strap 14 showing hair weave hooks 66 secured to a strap 64. In an exemplary embodiment, the strap 64 may comprise a plurality of fibers woven into a rectangular shape that can be produced in various lengths. The weave hooks 66 may be fabricated form a flexible, water-resistant material such as a plastic or a coated metal. The strap 64 provides a mounting surface for the hair weave hooks 66 and for hair braid hooks 68 on opposite sides of the strap 64. The hair braid hooks 68 attach to the top end (tracks) of the hair weave 18. The hair weave hooks 66 securely hook into the braided hair (e.g., corn roll) on the user's head. The hair attachment strap 14 makes it easy for the user or the salon to attach and detach the hair weave 18 from the user's head for the purpose of easily washing and drying the hair weave 18 with the hair weave folder 12 and the folder sleeve 20.

FIG. 8 is a rear view of the hair attachment strap 14 showing the hair braid hooks 68. FIG. 9 is a front view of the hair attachment strap 14 showing the hair weave hooks 66. FIG. 10 is a side view of the hair attachment strap 14 showing the curved configurations of the flexible hair weave hooks 66 and the similarly-flexible hair braid hooks 68.

Figure 12:
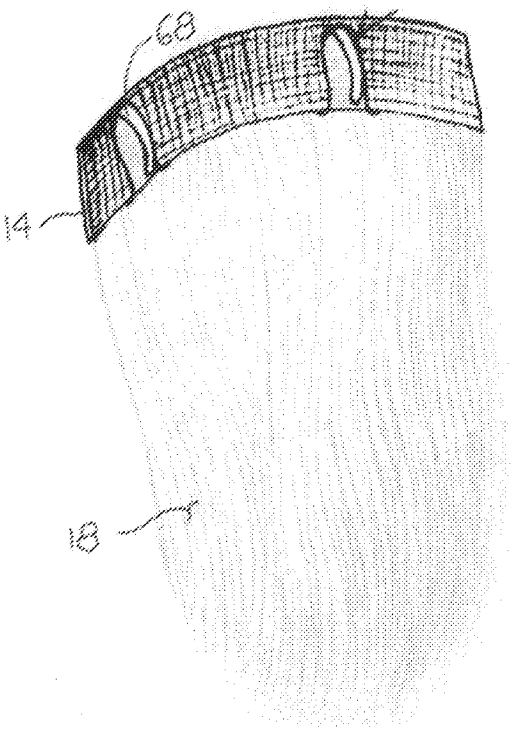
FIG. 12 is a rear view of the hair attachment strap and hair weave of FIG. 11.
Figure 11:
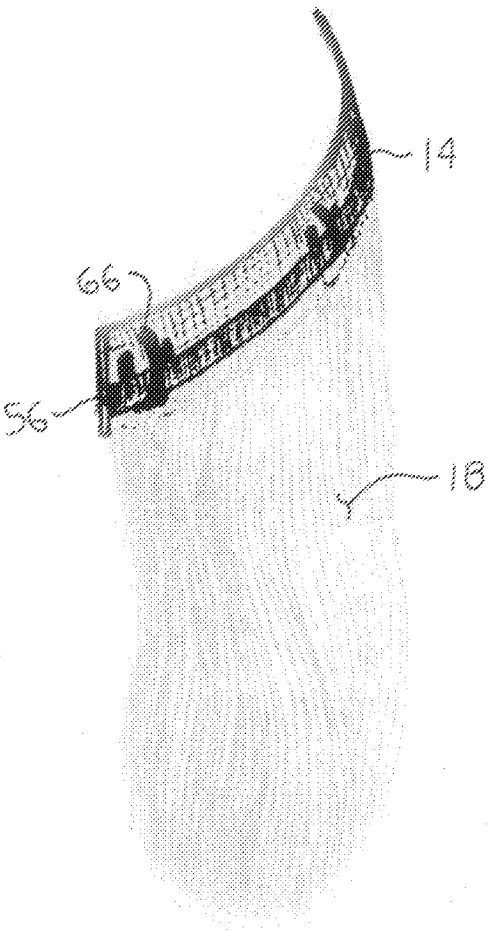
FIG. 11 is a front view of the hair attachment strap of FIG. 7 attached to a hair weave.

FIG. 11 shows a front view of the hair attachment strap 14 secured to the hair weave 18. A hair weave track 56 clips into the plurality of the hair weave hooks 66. FIG. 12 shows a rear view of the hair attachment strap 14 secured to the hair weave 18.

After the hair weave 18 has been attached to the hair attachment strap 14, as shown in FIGS. 11 and 12, the hair attachment strap 14 is placed into the attachment strip channel 42, as shown in FIG. 1. The individual hair strands of the hair weave 18 are arranged over the top mesh 46, and the folder base panel 30 is closed onto the folder top panel 40 to secure and restrain the hair weave 18 in the flattened configuration. The top panel studs 48 in the folder top panel 40 mate with and are inserted into corresponding base stud holes 38 in the folder base panel 30 to hold the folder top panel 40 and the folder base panel 30 in a closed configuration.

The hair weave folder 12 is inserted into the folder sleeve 20. The user may add a hair washing solution, a shampoo, a conditioner, or a hair dye solution to the folder sleeve 20 before closing with the folder sleeve cap 16. After the hair treatment process has been completed, the solution remaining in the folder sleeve 20 can be emptied using the sealable through hole 22, of FIG. 2, and the hair weave folder 12 can be removed from the folder sleeve 20. The hair weave 18 can be dried while in the hair weave folder 12 by any method desired by the user.

As can be appreciated by one skilled in the art, an obvious benefit of the hair weave wash and dry apparatus 10 is that the hair weave 18 will be easy to remove from the hair weave folder 12 and place back on the scalp. With easy removal of the hair weave 18, the user or the salon can wash, dry, and dye the hair weave 18 using the hair weave wash and dry apparatus 10.

It is to be understood that the description herein is only exemplary of the invention, and is intended to provide an overview for the understanding of the nature and character of the disclosed hair weave wash and dry system. The accompanying drawings are included to provide a further understanding of various features and embodiments of the method and devices of the invention which, together with their description serve to explain the principles and operation of the invention.

What is claimed is:

1. An apparatus for hair treatment comprising:
a folder;
a sleeve;
a cap;
the folder comprising a base panel and a top panel;
the base panel being hingedly attached to the top panel;
the sleeve being configured to enclose the base panel and the top panel;
the sleeve comprising an open end;
the cap being configured to cover the open end so as to render the folder retained in a water-tight volume in response to the base panel and the top panel being enclosed within the sleeve;
the top panel comprising a top mesh, a top frame and a plurality of top panel studs:
the top mesh being supported by and enclosed within the top frame;
the plurality of top panel studs extending from the top frame;
the plurality of top panel studs being spaced apart from one another;
the base panel comprising a base mesh, a base frame and a plurality of base panel holes;
the base mesh being supported by and enclosed within the base frame;
the plurality of base panel holes traversing into the base frame;
the plurality of base panel holes being spaced apart from one another; and
the top panel stud being configured to be inserted into the base panel hole.

2. The apparatus of claim 1 comprising:
the base panel comprising an attachment channel ; and
the attachment channel traversing into the base frame.

3. The apparatus of claim 2 comprising:
an attachment strap;
the attachment strap being configured to attach to a hair weave; and
the attachment strap being configured to be removable retained in the attachment channel.

4. The apparatus of claim 3 comprising:
at least one hook; and
the at least one hook being configured to secure the attachment strap to the base panel.

5. The apparatus of claim 1 comprising:
the sleeve comprising a sealable through hole to allow drainage of a fluid present in the sleeve.

* * * * *